US006778786B2

(12) United States Patent
Aritomo et al.

(10) Patent No.: US 6,778,786 B2
(45) Date of Patent: Aug. 17, 2004

(54) TONER REPLENISHING CONTAINER

(75) Inventors: Kouichi Aritomo, Osaka (JP); Chujiro Yokoyama, Osaka (JP); Takeru Kinoshita, Osaka (JP)

(73) Assignee: Minolta Co., Ltd., Osaka (JP)

( * ) Notice: Subject to any disclaimer, the term of this patent is extended or adjusted under 35 U.S.C. 154(b) by 22 days.

(21) Appl. No.: 09/912,564

(22) Filed: Jul. 26, 2001

(65) Prior Publication Data

US 2002/0015596 A1 Feb. 7, 2002

(30) Foreign Application Priority Data

Aug. 1, 2000 (JP) ..... 2000-233449

(51) Int. Cl.[7] ..... G03G 15/08
(52) U.S. Cl. ..... 399/12; 399/24
(58) Field of Search ..... 399/10, 12, 13, 399/258, 260, 24, 27

(56) References Cited

U.S. PATENT DOCUMENTS 4,607,939 A * 8/1986 Saito ..... 399/119
5,038,173 A * 8/1991 Kusumoto ..... 399/13
5,576,816 A 11/1996 Staudt et al.
5,697,008 A * 12/1997 Katoh et al. ..... 399/35
5,765,079 A 6/1998 Yoshiki et al.
5,822,663 A 10/1998 Ichikawa et al.
5,946,520 A * 8/1999 Hooper et al. ..... 399/12
5,983,059 A 11/1999 Oka et al.
2002/0102113 A1 * 8/2002 Kasano et al. ..... 399/262

FOREIGN PATENT DOCUMENTS

JP 59-126565 A * 7/1984
JP 4-338989 A * 11/1992
JP 4-338990 A * 11/1992
JP 11-30904 A * 2/1999
JP 2001-83791 * 3/2001

* cited by examiner

*Primary Examiner*—Quana Grainger
(74) *Attorney, Agent, or Firm*—Morrison & Foerster LLP

(57) ABSTRACT

A toner replenishing container for supplying toner to an image forming apparatus according to the invention includes: a container body for storing toner therein; a cap member attached to a mouth of the container body, the cap member having a toner outlet port and a shutter member for opening/closing the toner outlet port; and an indication member removably attachable to the cap member.

19 Claims, 7 Drawing Sheets

TONER REPLENISHING CONTAINER

BACKGROUND OF THE INVENTION

This application is based application No. 233449/2000 filed in Japan, the contents of which are hereby incorporated by reference.

1. Field of the Invention

The present invention relates to a toner replenishing container for use in image forming apparatuses such as copiers, printers and the like for supplying toner to the same. More particularly, the invention relates to a toner replenishing container with a cap member attached to a mouth of a container body storing toner therein, the container adapted for a positive supply of a proper type of toner to any one of the various types of image forming apparatuses in an application where plural toner replenishing containers are individually filled with any one of the various types of toners different in color or the like for toner supply to the various types of image forming apparatuses.

2. Description of the Related Art

In the conventional image forming apparatuses such as copiers, printers and the like, the following procedure is taken to replenish toner to the apparatuses. The procedure includes the steps of filling a toner replenishing container with toner, and loading the toner replenishing container in the image forming apparatus for supplying the toner from the toner replenishing container to the image forming apparatus.

The toner for use in the image forming apparatuses is generally varied depending upon the types of the image forming apparatuses. Accordingly, it has been a conventional practice to vary the configuration or the like of the toner replenishing container for toner storage depending upon the types of the image forming apparatuses used.

Unfortunately, a great number of various toner replenishing containers are required if the toner replenishing container is varied in configuration or the like depending upon the types of the image forming apparatuses used. This leads not only to high production costs but also to a cumbersome management of the containers. Furthermore, the reuse of such toner containers requires the toner containers to be filled with the same type of toners as the previous toners. As a result, an efficient reuse of the toner containers is not accomplished.

In this connection, it has been contemplated to design the toner replenishing containers for toner storage in a regular configuration and size such that the toner containers of a kind may store different types of toners so as to be shared by the image forming apparatuses.

However, the following problem is encountered by the toner replenishing containers of the regular configuration and size which store different types of toners. In the replenishment of toner to an image forming apparatus via a toner replenishing container, an improper type of toner may be inadvertently supplied to the apparatus.

More recently, a countermeasure against such a problem has been proposed by U.S. Pat. No. 5,983,059 wherein a non-compatible member is removably attached to the toner container, the non-compatible member formed with an engagement portion configured differently depending upon the type or color of toner to be stored in the toner container.

In the approach wherein the toner container is provided with the non-compatible member formed with the engagement portion varied in configuration depending upon the type or color of the toner, there are required a great number of non-compatible members of various configurations. This still results in the high production costs and the cumbersome management of the non-compatible members.

SUMMARY OF THE INVENTION

It is an object of the invention to provide toner replenishing containers of a kind capable of storing various toners of different colors or the like for supplying various toners to various types of image forming apparatuses, the toner containers featuring a simple structure added thereto thereby ensuring that the toner replenishing containers are prevented from supplying improper types of toners to the image forming apparatuses.

According to the invention, the toner replenishing container for supplying toner to the image forming apparatus comprises:

a container body for storing toner therein; a cap member attached to a mouth of the container body, the cap member having a toner outlet port and a shutter member for opening/closing the toner outlet port; and an indication member removably attachable to the cap member.

The position and the number of the indication member to be attached to the cap member are varied depending upon the type of toner stored in the container body. Further, the indication member thus attached to the cap member provides determination as to whether the toner replenishing container may be loaded on a toner supply portion of the image forming apparatus or not.

The arrangement permits the type of toner stored in the toner replenishing container to be readily identified based on the position and the number of indication member(s) thus attached. Furthermore, the indication member prevents the toner replenishing container from being loaded on a wrong one of the toner supply portions of the image forming apparatus.

The arrangement is made such that the indication member to be attached to the cap member is varied in the position and the number thereof depending upon the type of toner stored in the container body. Therefore, a simple arrangement permits the type of toner stored in the toner replenishing container to be distinguished. In addition, the containers are adapted to store different types of toners in a manner to distinctively present the contents thereof through mere variations of the position and the number of the indication members. Hence, the general versatility of the toner replenishing container is enhanced.

These and other objects, advantages and features of the invention will become apparent from the following description thereof taken in conjunction with the accompanying drawings which illustrate a specific embodiment of the invention.

DESCRIPTION OF THE PREFERRED EMBODIMENT

A toner replenishing container according to a preferred embodiment of the invention will hereinbelow be described in detail with reference to the accompanying drawings.

Figure 1:
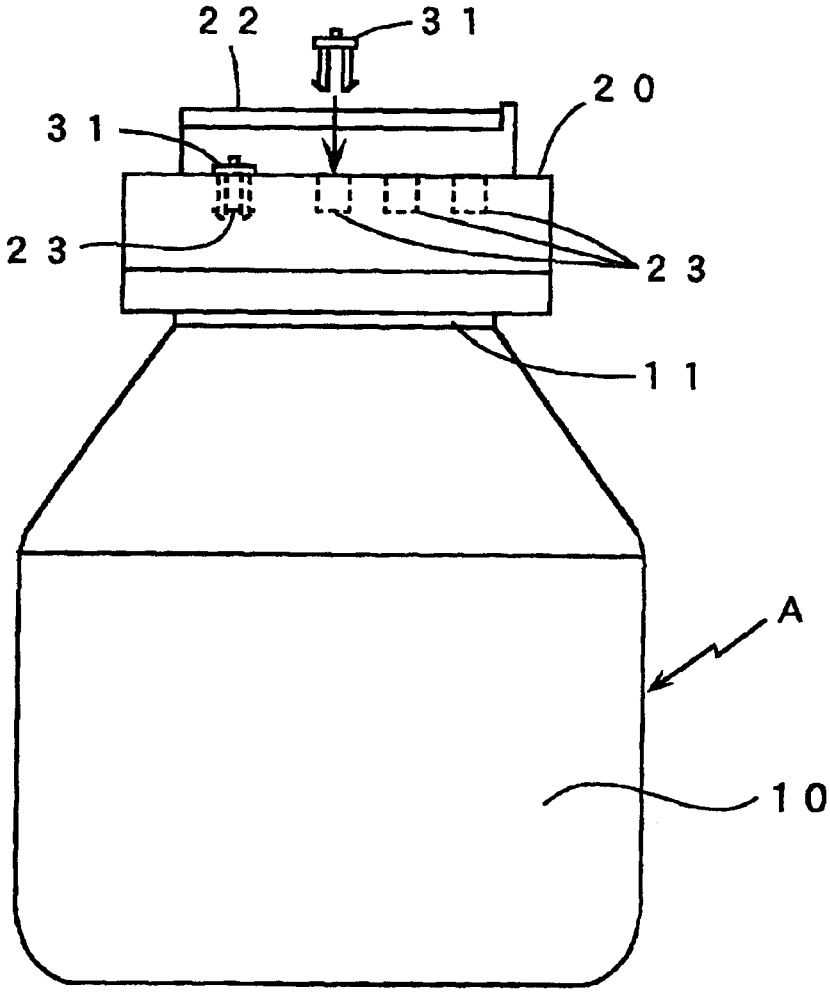
FIG. 1 is a front view schematically showing a toner replenishing container according to one embodiment of the invention.
Figure 2:
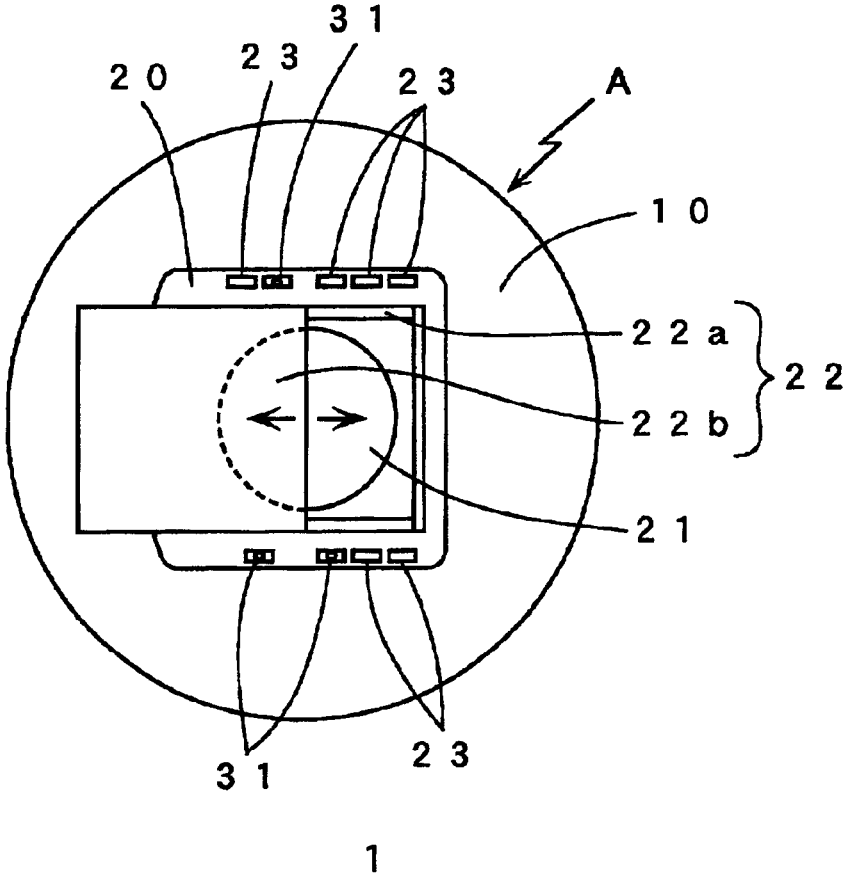
FIG. 2 is a plan view schematically showing the toner replenishing container of the above embodiment.

As shown in FIGS. 1 and 2, a toner replenishing container A according to the embodiment has an arrangement wherein a cap member 20 is attached to a mouth 11 shaped like a cylinder projecting from an upper end of a container body 10 for storing toner therein.

The cap member 20 includes a toner outlet port 21 in its upper surface through which the toner stored in the container body 10 is supplied. The cap member 20 is further provided with a shutter mechanism 22 for opening/closing the toner outlet port 21, the mechanism including a guide member 22*a* disposed in the vicinity of the toner outlet port 21, and a slide member 22*b* slidably movable along the guide member 22*a* for opening/closing the toner outlet port 21.

Figure 3:
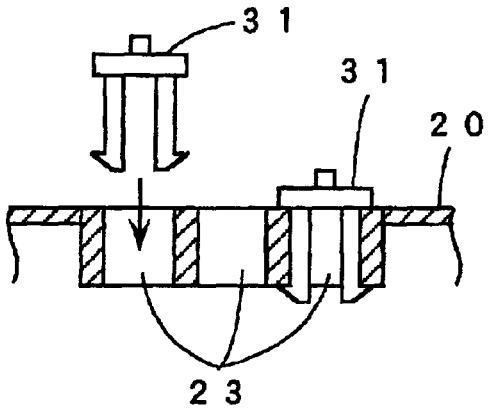
FIG. 3 is a fragmentary view of the toner replenishing container of the above embodiment for illustrating an indication member inserted to be locked in a suitable one of mounting holes formed in a top surface of a cap member.

The cap member 20 is formed with a plurality of mounting holes 23 at suitable positions of the upper surface thereof for receiving an indication member 31. As shown in FIG. 3, the indication members 31 are inserted to be locked in some suitable ones of the mounting holes 23 in correspondence to a type of toner stored in the container body 10.

Figure 4:
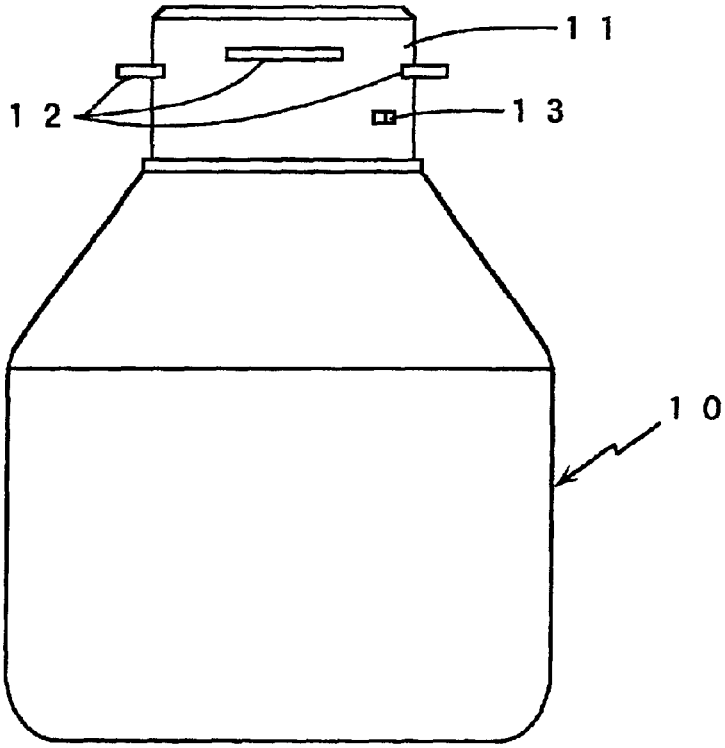
FIG. 4 is a front view schematically showing a container body employed by the toner replenishing container of the above embodiment.
Figure 5:
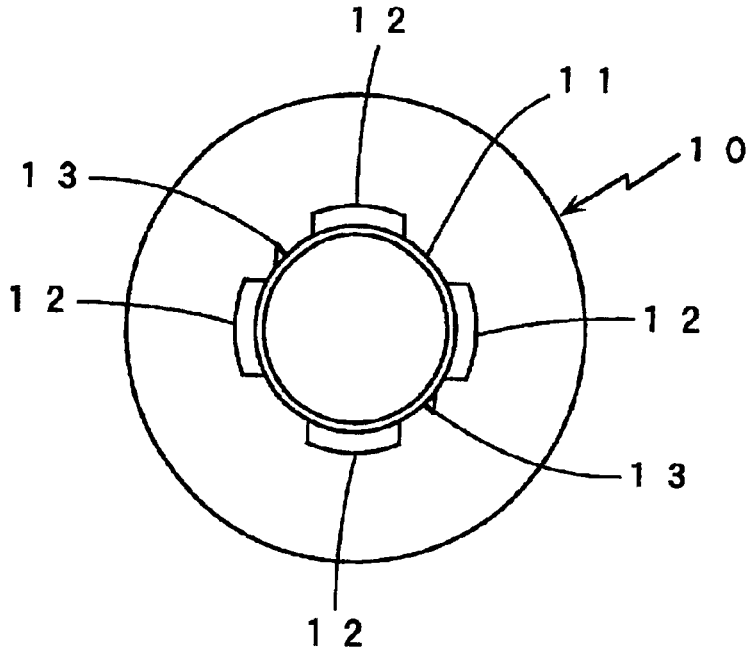
FIG. 5 is a plan view schematically showing the container body employed by the toner replenishing container of the above embodiment.

In the toner replenishing container A of the embodiment, disposed on an outer periphery of the mouth 11 of the container body 10 are a fixing portion 12 for fixing the cap member 20 and a counterrotation-preventing projection 13 for preventing the cap member 20 from rotating in a reverse direction, as shown in FIGS. 4 and 5. The projection 13 is located downwardly of the fixing portion 12.

Figure 6:
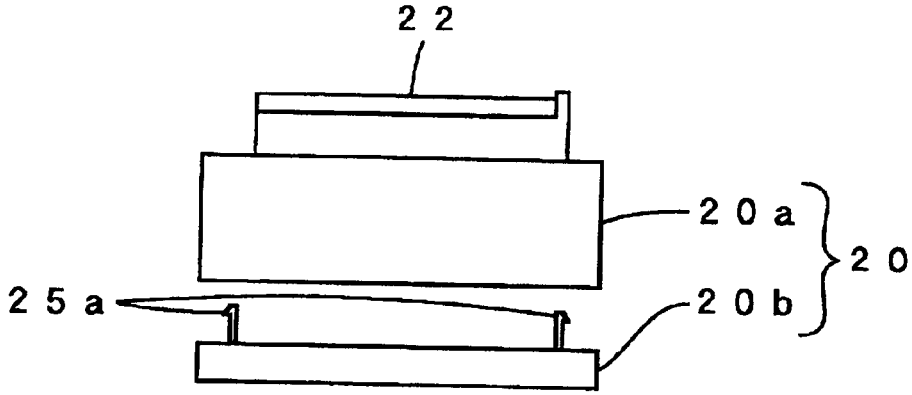
FIG. 6 is a schematic diagram showing a first cap member and a second cap member separated from each other, the first and second cap members belonging to the cap member employed by the toner replenishing container of the above embodiment.

On the other hand, the cap member used herein includes a first cap member 20*a* and a second cap member 20*b*, as shown in FIG. 6. The second cap member 20*b* includes a plurality of locking claws 25*a* projected toward the first cap member 20*a* so as to be locked to the first cap member 20*a* for combining the first cap member 20*a* and the second cap member 20*b* together.

Figure 7:
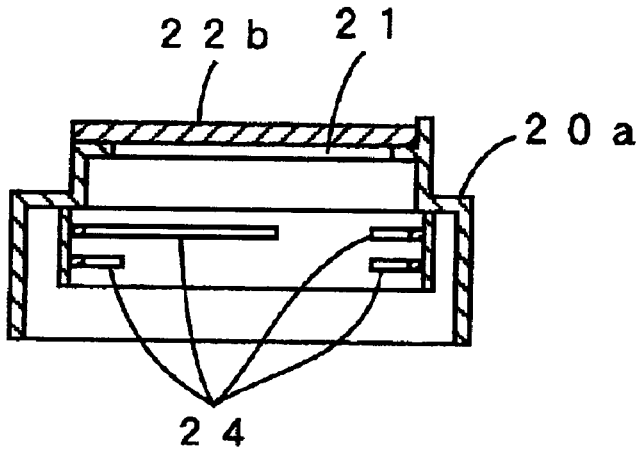
FIG. 7 is a sectional view schematically showing the first cap member employed by the toner replenishing container of the above embodiment.
Figure 8:
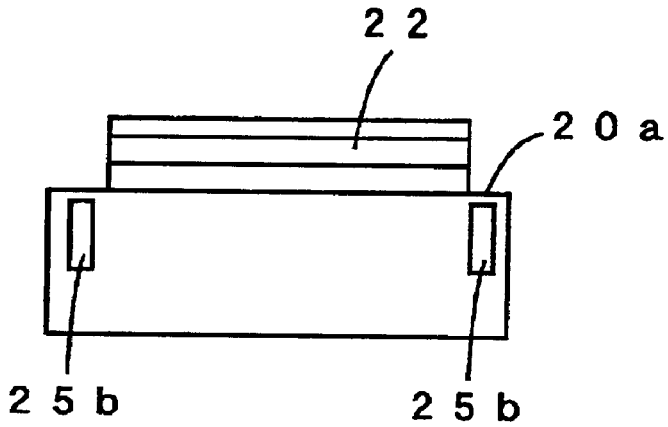
FIG. 8 is a side view schematically showing the first cap member employed by the toner replenishing container of the above embodiment.

The first cap member 20*a* includes the toner outlet port 21, the shutter mechanism 22 for opening/closing the toner outlet port 21 and the plural mounting holes 23 for mounting the indication member 31. As shown in FIGS. 7 and 8, the first cap member 20*a* is formed with an engagement portion 24 on an inner periphery thereof so as to engage with the fixing portion 12 on the mouth 11 of the container body 11. The first cap member 20*a* is further formed with a plurality of lock holes 25*b* in its side wall, which receive the locking claws 25*a* projected from the second cap member 20*b*.

Figure 9:
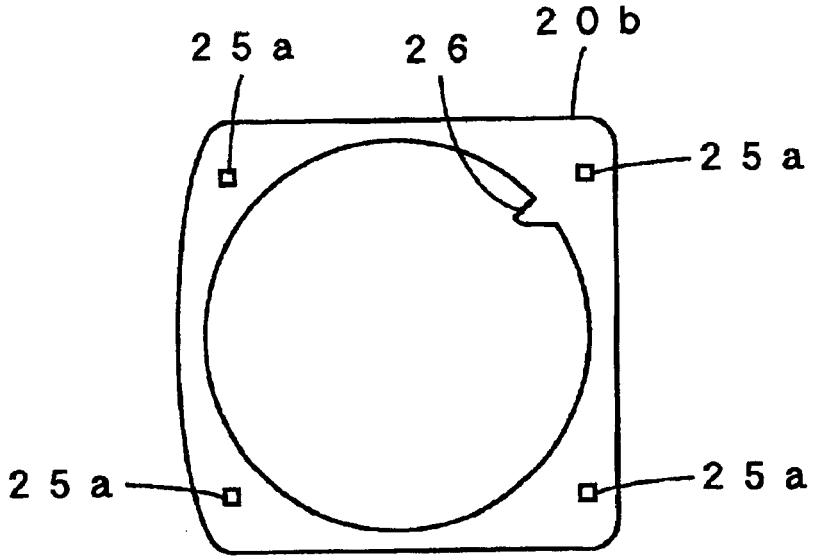
FIG. 9 is a plan view schematically showing the second cap member employed by the toner replenishing container of the above embodiment.

On the other hand, the second cap member 20*b* is formed with a lock extension 26 on its inner periphery, as shown in FIG. 9. The lock extension 26 is locked to the counterrotation-preventing projection 13 on the mouth 11 of the container body 10, such that the cap member 20 is prevented from rotating in the reverse direction.

Figure 10:
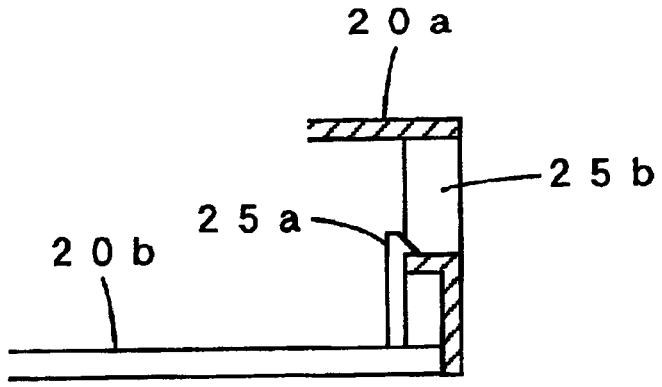
FIG. 10 is a fragmentary view showing the toner replenishing container of the above embodiment wherein the first cap member and the second cap member are combined with each other.

As shown in FIG. 10, the first cap member 20*a* is fitted over the second cap member 20*b*, thereby bringing the locking claws 25*a* of the second cap member 20*b* into locked relation with the lock holes 25*b* in the side wall of the first cap member 20*a* for combining together the first cap member 20*a* and the second cap member 20*b*. The first cap member 20*a* may be separated from the second cap member 20*b* using a suitable jig (not shown) to push the individual locking claws 25*a* locked to the lock holes 25*b* thereby releasing the locking claws 25*a* from the lock holes 25*b*.

Next, description is made on a case where the toner replenishing container A of the embodiment is used for supplying a full-color image forming apparatus B with a toner of a suitable color.

First, a toner of a suitable color is filled in the container body 10 of the toner replenishing container A. In correspondence to the toner thus filled in the container body 10, a suitable number of indication members 31 are inserted to be locked in mounting holes 23 at suitable positions on the upper surface of the first cap member 20*a*.

Next, the first cap member 20*a* is fitted over the second cap member 20*b* while the locking claws 25*a* of the second cap member 20*b* are locked to the lock holes 25*b* in the side wall of the first cap member 20*a*. Thus, the first cap member and the second cap member 20*b* are combined together.

With the first cap member 20*a* and the second cap member 20*b* thus combined together, the engagement portion 24 on the inner periphery of the first cap member 20*a* is brought into engagement with the fixing portion 12 on the mouth 11 of the container body 10 filled with the toner, while the lock extension 26 on the inner periphery of the second cap member 20*b* is locked to the counterrotation-preventing projection 13 on the mouth 11 of the container body 11. Thus, the cap member 20 is fitted on the outer periphery of the mouth 11 of the container body 10. The cap member 20 thus mounted is prevented from counterrotating by means of the lock extension 26 of the second cap member 20*b* locked by the counterrotation-preventing projection 13 on the mouth 11 of the container body 10. It is thus ensured that the cap member 20 is positively prevented from disengaging from the container body 10 due to vibration and the like during transportation, the disengaged cap member resulting in toner leakage or the like.

Figure 11:
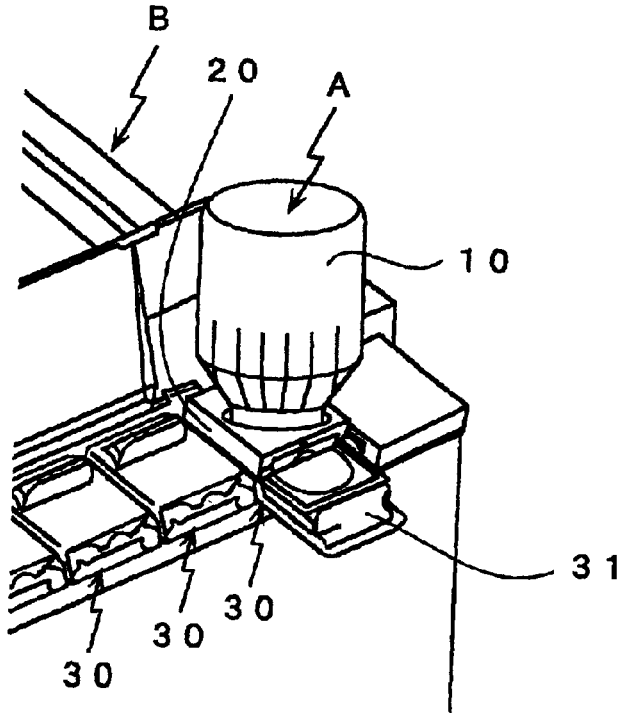
FIG. 11 is a fragmentary view illustrating the toner replenishing container of the above embodiment loaded on a corresponding one of toner supply portions of the image forming apparatus.
Figure 12:
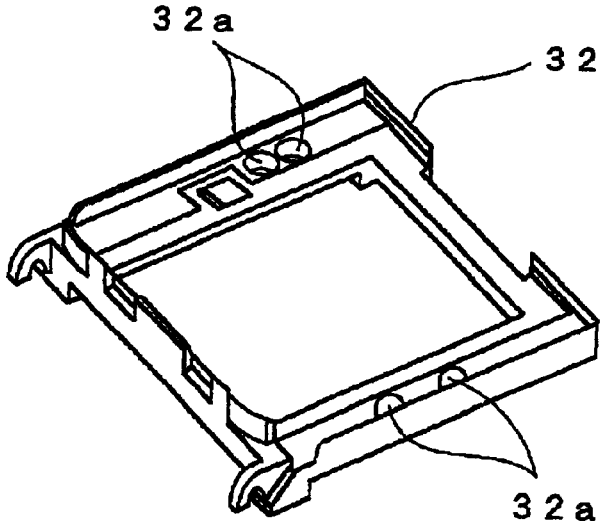
FIG. 12 is a perspective view schematically showing a receptacle of the toner supply portion on which the toner replenishing container of the above embodiment is loaded.

The toner replenishing container A storing the toner of a suitable color supplies such a toner to the full-color image forming apparatus as follows. As shown in FIG. 11, out of a plurality of toner supply portions 30 provided at the full-color image forming apparatus B, a toner supply portion 30 corresponding to the toner of the above color stored in the toner replenishing container A is selected and a lid 31 thereof is opened so as to expose a receptacle 32 on which the toner replenishing container A is loaded (see FIG. 12).

The cap member 20 is turned downward with the toner outlet port 21 closed by the slide member 22*b* disposed at the first cap member 20*a* of the toner replenishing container A. Then, the indication members 31 inserted in the upper surface of the first cap member 20*a* are inserted in holes 32*a* formed at the receptacle 32 so that the toner replenishing container A may be loaded on the receptacle 32 with its lid 31 opened. If, at this time, a color of a toner to be supplied to the toner supply portion 30 does not correspond with that of the toner stored in the toner replenishing container A, the position of the indication member 31 inserted in the upper surface of the first cap member 20*a* does not coincide with the position of the hole 32*a* formed at the receptacle 32 of the toner supply portion 30. Therefore, the toner replenishing container A cannot be loaded on the toner supply portion 30 and hence, the toner of the wrong color is prevented from being supplied.

After the toner replenishing container A with the cap member 20 turned downward has been loaded on a suitable toner supply portion 30 of the image forming apparatus B, the slide member 22*b* is slid to open the toner outlet port 21, through which the toner stored in the toner replenishing container A is fed into the image forming apparatus B via the toner supply portion 30. Subsequently, the slide member 22*b* is slid back to place so as to close the toner outlet port 21. In this state, the toner replenishing container A is removed from the toner supply portion 30 while the lid 31 of the toner supply portion 30 is closed.

After the toner supply to the image forming apparatus B, the following procedure is taken to fill the toner replenishing container A with fresh toner for reuse of the container. A suitable jig (not shown) is used for pushing the locking claws 25*a* of the second cap member 20*b* locked to the lock holes 25*b* of the first cap member 20*a* thereby releasing the claws 25*a* from the lock holes 25*b*. Thus, the first cap member 20*a* is separated from the second cap member 20*b*. Subsequently, the lock extension 26 of the second cap member 20*b* is released from the counterrotation-preventing projection 13 of the container body 10.

The first cap member 20*a* and the second cap member 20*b* so separated from each other are rotated in the reverse direction thereby releasing the engagement portion 24 of the first cap member 20*a* from the fixing portion 12 of the container body 10. Thus, the first cap member 20*a* and the second cap member 20*b* are removed from the container body 10.

If the first cap member 20*a* and the second cap member 20*b* are disassembled from the container body 10 in this manner, the cleaning of these parts as well as the toner charging in the container body 10 may be facilitated.

In a case where the container body 10 is filled with a toner of the same color as that of the previous toner, the indication members 31 inserted to be locked in the mounting holes 23 of the first cap member 20*a* are used as they are. In a case where the container body 10 is filled with a toner of a different color from that of the previous toner, the indication members 31 inserted and locked in the mounting holes 23 are removed. Subsequently, a suitable number of indication members 31 may be inserted to be locked in suitable mounting holes 23 in the upper surface of the first cap member 20*a* in correspondence to the color of the toner to be replenished.

According to the toner replenishing container A of the embodiment, the color of the toner stored in the toner replenishing container A is distinctively presented simply by changing the position and the number of the indication member 31 to be attached to the cap member 20 in correspondence to the color of the toner. This provides for an easy reuse of the toner replenishing container A which may be filled with a toner of a different color from that of the previous toner. As a result, the general versatility of the toner replenishing container is enhanced.

The embodiment of the invention has been described with reference to the case where the toner replenishing container A is filled with any one of the toners of different colors for supplying a suitably colored toner to the full-color image forming apparatus. However, in a case where the toner replenishing container A is adapted for toner replenishment to various types of image forming apparatuses by being filled with a toner of different characteristics from those of the previous toner, the type of toner stored in the toner replenishing container A may be distinctively indicated by changing the position and the number of the indication member 31 to be attached to the cap member 20 as described in the foregoing.

Although the present invention has been fully described by way of examples, it is to be noted that various changes and modifications will be apparent to those skilled in the art.

Therefore, unless otherwise such changes and modifications depart from the scope of the present invention, they should be construed as being included therein.

What is claimed is:

1. A toner replenishing container for supplying toner to an image forming apparatus comprising:

a container body for storing toner therein;

a cap member attached to a mouth of the container body, the cap member having a toner outlet port and a shutter member for opening/closing the toner outlet port; and an indication member removably attachable to the cap member to indicate a kind of toner in the container, even with the toner replenishing container detached from the image forming apparatus wherein the indication member serves as a control member for inhibiting the toner replenishing container from being loaded on a toner supply portion of the image forming apparatus if the indication member does not coincide with a structure of the toner supply portion.

2. The toner replenishing container as claimed in claim 1, wherein the cap member has a plurality of mounting portions permitting the mounting of the indication member.

3. The toner replenishing container as claimed in claim 2, wherein the plural mounting portions are a plurality of mounting holes.

4. The toner replenishing container as claimed in claim 3, wherein the indication member is mounted in a predetermined mounting hole according to a type of toner stored in the container body.

5. The toner replenishing container as claimed in claim 3, wherein a plurality of indication members are mounted in the mounting holes according to a type of toner stored in the container body.

6. The toner replenishing container as claimed in claim 3, wherein the container body has a fixing portion for fixing the cap member and a counterrotation-preventing projection for preventing the cap member fixed to the fixing portion from rotating in a reverse direction.

7. The toner replenishing container as claimed in claim 6, wherein the cap member has a first cap member and a second cap member removably engaged with the first cap member.

8. The toner replenishing container as claimed in claim 7, wherein the first cap member has the toner outlet port, the shutter member, the mounting holes, and an engagement portion for engaging with the fixing portion of the container body.

9. The toner replenishing container as claimed in claim 8, wherein the fixing portion is formed on an outer surface of the container body whereas the engagement portion is formed on an inner periphery of the first cap member.

10. The toner replenishing container as claimed in claim 7, wherein the second cap member has a lock extension locked to the counterrotation-preventing projection of the container body.

11. The toner replenishing container as claimed in claim 10, wherein the counterrotation-preventing projection is formed on an outer surface of the container body whereas the lock extension is formed on an inner periphery of the second cap member.

12. A toner replenishing container for supplying toner to an image forming apparatus comprising:

a container body for storing toner therein; and a cap member attached to a mouth of the container body, the cap member comprising a first cap member and a second cap member removably engaged with the first cap member, wherein the container body has a fixing portion for fixing the cap member and a counterrotation-preventing projection for preventing the cap member fixed to the fixing portion from rotating in a reverse direction; wherein the first cap member has a toner outlet port, a shutter member for opening/closing the toner outlet port, and an engagement portion for engaging with the fixing portion of the container body; and wherein the second cap member has an extension locked to the counterrotation-preventing projection of the container body.

13. The toner replenishing container as claimed in claim 12, wherein the fixing portion is formed on an outer surface of the container body whereas the engagement portion is formed on an inner periphery of the first cap member.

14. The toner replenishing container as claimed in claim 12, wherein the counterrotation-preventing projection is formed on an outer surface of the container body whereas the lock extension is formed on an inner periphery of the second cap member.

15. The toner replenishing container as claimed in claim 12, wherein the first cap member has a plurality of mounting holes to which an indication member is removably attached.

16. The toner replenishing container as claimed in claim 15, wherein the indication member serves as a control member for determining whether the toner replenishing container may be loaded on a toner supply portion of the image forming apparatus or not.

17. A toner replenishing container for supplying toner to an image forming apparatus comprising:

a container body for storing toner therein, the toner body having g plurality of mounting holes; and at least one indication member which is removably attached to one of the mounting holes to indicate a kind of toner in the container.

18. A method of producing a toner container for supplying toner to an image forming apparatus, said method comprising:

filling the toner container with toner, and attaching a cap member to the toner container, said cap member having at least one indication member which in inserted into one of a plurality of mounting holes on the cap member to indicate a kind of toner in the container.

19. A method of producing a atoner container for supplying toner to an image forming apparatus, said method comprising:

filling the toner container with toner; and inserting at least one indication member into a plurality of mounting holes on the toner container to indicate a kind of toner in the container.

* * * * *